US007153175B2

(12) United States Patent
Takada et al.

(10) Patent No.: US 7,153,175 B2
(45) Date of Patent: Dec. 26, 2006

(54) OUTBOARD MOTOR SHIFT CONTROL SYSTEM

(75) Inventors: Hideaki Takada, Wako (JP); Taiichi Otobe, Wako (JP); Shinsaku Nakayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/256,335

(22) Filed: Oct. 21, 2005

(65) Prior Publication Data

US 2006/0089064 A1 Apr. 27, 2006

(30) Foreign Application Priority Data

Oct. 25, 2004 (JP) ..... 2004-309809

(51) Int. Cl.
*B63H 21/21* (2006.01)

(52) U.S. Cl. ..... 440/86; 440/1

(58) Field of Classification Search ..... 440/1, 440/86, 87; 318/700, 703
See application file for complete search history.

(56) References Cited

U.S. PATENT DOCUMENTS 4,085,355 A * 4/1978 Fradella ..... 318/703
5,910,191 A * 6/1999 Okamoto ..... 440/86
6,238,255 B1 5/2001 Takase

FOREIGN PATENT DOCUMENTS

| | | |
|---|---|---|
| JP | 2000-085688 | 3/2000 |
| JP | 2003-231498 | 8/2003 |

* cited by examiner

*Primary Examiner*—Lars A. Olson
(74) *Attorney, Agent, or Firm*—Carrier, Blackman & Associates, P.C.; Joseph P. Carrier; William D. Blackman

(57) ABSTRACT

In an outboard motor shift control system having a shift mechanism including a forward gear, a reverse gear and a clutch and an electric motor moving the clutch to engage with one of the forward and reverse gears or to disengage it therefrom, current supplied to the motor is detected, and completion of shift change is discriminated based on the detected current. With this, it becomes possible to detect completion of the shift change accurately, without being affected by shift mechanism aging and manufacturing variances.

10 Claims, 13 Drawing Sheets

OUTBOARD MOTOR SHIFT CONTROL SYSTEM

BACKGROUND OF THE INVENTION

1. Field of the Invention

This invention relates to an outboard motor shift control system.

2. Description of the Related Art

In most outboard motors, shift change is conducted by operating a shift mechanism equipped with a dog clutch, either manually or by use of an actuator, as taught, for example, in Japanese Laid-Open Patent Application No. 2003-231498 (particularly paragraph 0022 and FIG. 4). Specifically, shift change is conducted by sliding a clutch formed with projections, manually or by use of an actuator, so as to bring the projections into engagement with projections provided on a forward gear or projections provided on a reverse gear.

When the shift mechanism is operated by an actuator, it is necessary to detect clutch position for controlling the operation of the actuator. The clutch position has conventionally been detected using a sensor, such as a potentiometer or an encoder, or a switch, as taught, for example, in Japanese Laid-Open Patent Application No. 2000-85688 (particularly paragraph 0039 and FIG. 3).

The position of the clutch when shift change is completed (when the clutch has been slid to the point that the tips (tops or distal ends) of the clutch projections (teeth) or the tips of the gear projections (teeth) strike against recesses (the lands between the projections) of the other of these members) may differ in one and the same shift mechanism owing to aging (projections wear and the like) and between different shift mechanisms owing to manufacturing variances. Completion of shift change can therefore not always be accurately ascertained when a sensor or switch is used to detect clutch position.

SUMMARY OF THE INVENTION

An object of this invention is therefore to overcome this problem by providing an outboard motor shift control system that enables completion of shift change to be discriminated or detected accurately, without being affected by shift mechanism aging and manufacturing variances.

In order to achieve the object, this invention provides a system for controlling shift of an outboard motor mounted on a stern of a boat and having a powered propeller that propels the boat in a forward or reverse direction in response to a shift position selected one from among a forward position, a reverse position and a neutral position, comprising: a shift mechanism including at least a forward gear, a reverse gear and a clutch disposed to be engageable with the forward gear and the reverse gear; an electric actuator moving the clutch to engage with the forward gear to change shift to the forward position, or to engage with the reverse gear to change shift to the reverse position, or to disengage the clutch from the forward gear or the reverse gear to change shift to the neutral position; a current sensor detecting current supplied to the actuator; a discriminator discriminating whether the shift change is completed based on the detected current.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Embodiments of an outboard motor shift control system according to the present invention will now be explained with reference to the attached drawings.

Figure 1:
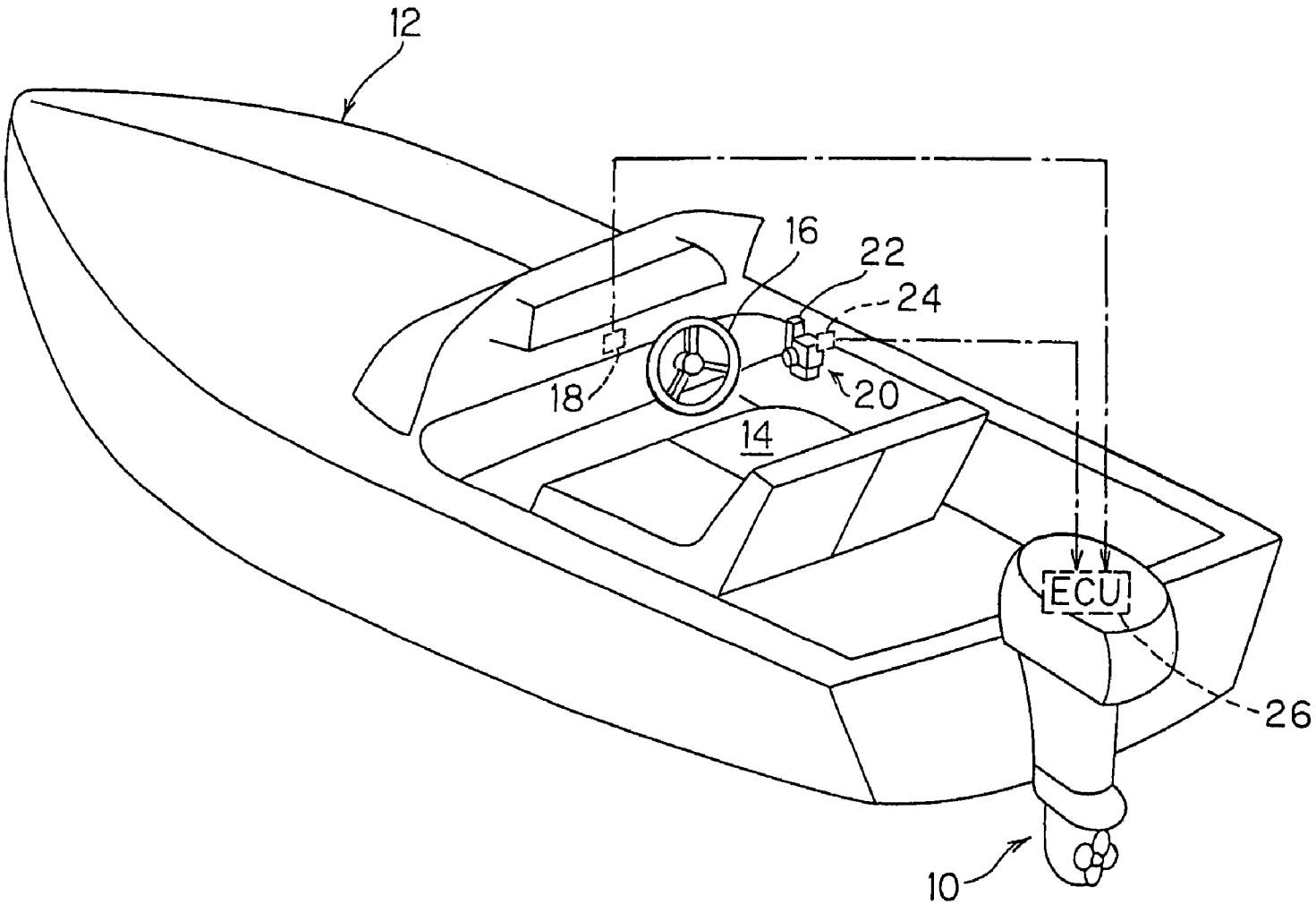
FIG. 1 is an overall schematic view of an outboard motor shift control system according to a first embodiment of the invention.
Figure 2:
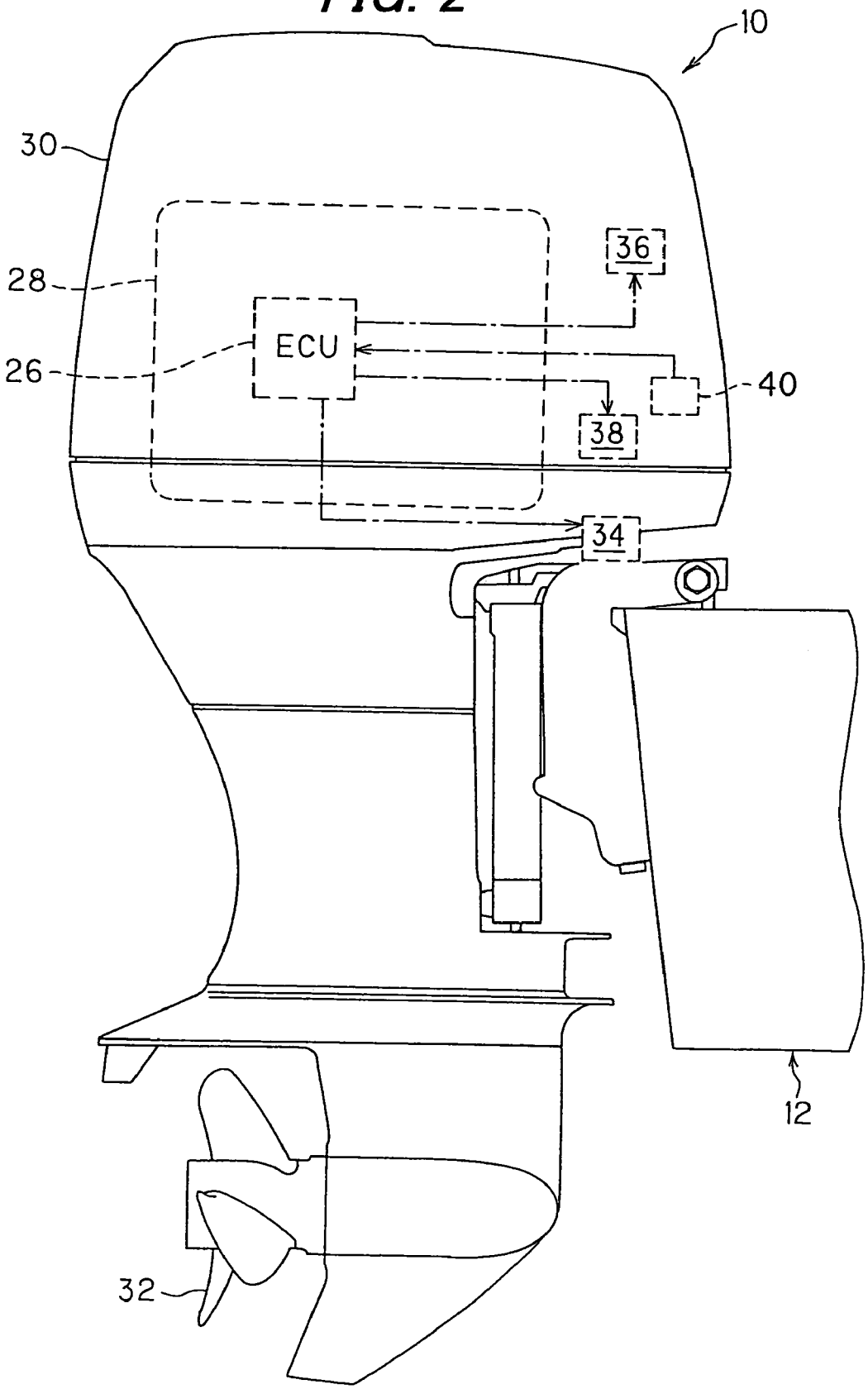
FIG. 2 is a side view of the outboard motor shown in FIG. 1.

FIG. 1 is an overall schematic view of an outboard motor shift control system according to a first embodiment of the invention and FIG. 2 is a side view of the outboard motor shown in FIG. 1.

In FIGS. 1 and 2, the symbol 10 indicates an outboard motor. The outboard motor 10 is mounted on the stern (transom) of a boat (hull) 12. As shown in FIG. 1, a steering wheel 16 is installed near a cockpit (the operator's seat) 14 of the boat 12. A steering wheel angle sensor 18 is installed near a shaft (not shown) of the steering wheel 16 and produces an output or a signal indicative of the rotation amount of the steering wheel 16, i.e., the steering angle (manipulated variable) of the steering wheel 16 manipulated by the operator.

A remote control box 20 is installed near the cockpit 14. The remote control box 20 is installed or provided with a lever 22 that is to be manipulated by the operator. Specifically, the lever 22 is free to rotate in the backward and forward directions (pulling and pushing directions for the operator, i.e., the direction in which the boat travels) from the initial position, and is positioned to be manipulated by the operator to input an instruction to shift or to regulate a speed of an internal combustion engine.

The remote control box 20 is equipped with a lever position sensor 24 that produces outputs or signals in response to a manipulated angle of the lever 22 manipulated by the operator. The outputs from the steering wheel angle sensor 18 and lever position sensor 24 are sent to an electronic control unit (hereinafter referred to as "ECU") 26 mounted on the outboard motor 10. The ECU 26 comprises a microcomputer.

As shown in FIG. 2, the outboard motor 10 is equipped with an internal combustion engine 28 (hereinafter referred to as "engine") at its upper portion. The engine 28 comprises a spark-ignition gasoline engine. The engine 28 is located above the water surface and covered by an engine cover 30. The ECU 26 is installed in the engine cover 30 at a location near the engine 28.

The outboard motor 10 is equipped at its lower portion with a propeller 32. The outputs of the engine 28 is transmitted to the propeller 32 through a shift mechanism (described below) and the like, such that the propeller 32 is rotated to generate thrust that propels the boat 12 in the forward and reverse directions.

The outboard motor 10 is further equipped with a steering actuator such as an electric motor (steering motor) 34 that steers the outboard motor 10 to the right and left directions, a throttle actuator such as an electric motor (throttle motor) 36 that opens and closes a throttle valve (not shown in FIG. 2) of the engine 28 and a shift actuator such as an electric motor (shift motor) 38 that operates the shift mechanism (not shown in FIG. 2) to change a shift position.

A current sensor 40 is disposed near the shift motor 38 to detect a drive current dc supplied to the motor 38. The output of the current sensor 40 is sent to the ECU 26. The ECU 26 discriminates or detects that the shift has been changed on the basis of, from among the outputs of the above-mentioned sensors, the output indicative of change in the drive current dc detected by the current sensor 40, as explained below.

The ECU 26 controls the operation of the steering motor 34 based on the output of the steering angle sensor 18 to steer the outboard motor 10 left and right. The ECU 26 also changes the shift position, i.e., conducts the shift change by controlling the operation of the shift motor 38 based on the manipulated angle of the lever 22 detected by the lever position sensor 24 (more exactly, the manipulated direction of the lever 22 determined from the detected value).

The ECU 26 terminates the operation of the shift motor 38, when is determined that the shift change has been completed or finished based on the detected value of the current sensor 40. It also controls the operation of the throttle motor 36 based on the manipulated angle of the lever 22 (more exactly, the magnitude of the detected value) to regulate the engine speed instructed by the operator.

Figure 3:
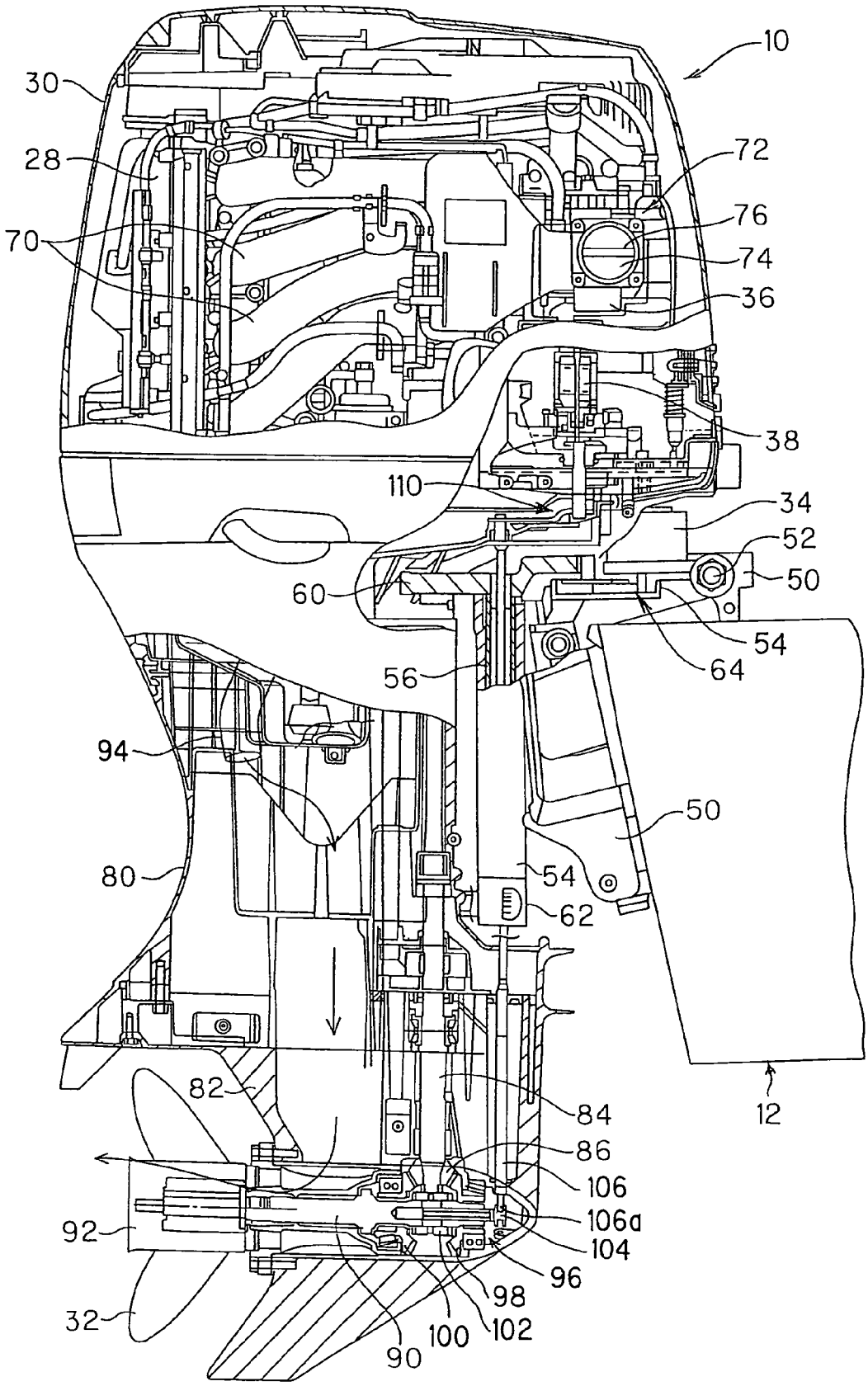
FIG. 3 is a partial sectional view of the outboard motor shown in FIG. 1.

The structure of the outboard motor 10 will then be described in detail with reference to FIG. 3. FIG. 3 is a partial sectional view of the outboard motor 10.

As shown in FIG. 3, the outboard motor 10 is equipped with stem brackets 50 fastened to the stem of the boat 12, such that the outboard motor 10 is mounted on the stem of the boat 12 through the stem brackets 50. A swivel case 54 is attached to the stem brackets 50 through a tilting shaft 52.

A swivel shaft 56 is housed in the swivel case 54 to be freely rotated about a vertical axis. The upper end of the swivel shaft 56 is fastened to a mount frame 60 and the lower end thereof is fastened to a lower mount center housing 62. The mount frame 60 and lower mount center housing 62 are fastened to a frame constituting a main body of the outboard motor 10.

The upper portion of the swivel case 54 is installed with the steering motor 34. The output shaft of the steering motor 34 is connected to the mount frame 60 via a speed reduction gear mechanism 64. Specifically, a rotational output generated by driving the steering motor 34 is transmitted via the speed reduction gear mechanism 64 to the mount frame 60 such that the outboard motor 10 is steered about the swivel shaft 56 as a rotational axis to the right and left directions (i.e., steered about the vertical axis).

The engine 28 has an intake pipe 70 that is connected to a throttle body 72. The throttle body 72 has a throttle valve 74 installed therein and the throttle motor 36 is integrally disposed thereto. The output shaft of the throttle motor 36 is connected via a speed reduction gear mechanism (not shown) installed near the throttle body 72 with a throttle shaft 76 that supports the throttle valve 74. Specifically, a rotational output generated by driving the throttle motor 36 is transmitted to the throttle shaft 76 to move the throttle valve 74, thereby regulating air sucked in the engine 28 to control the engine speed.

An extension case 80 is installed at the lower portion of the engine cover 30 that covers the engine 28 and a gear case 82 is installed at the lower portion of the extension case 80. A drive shaft (vertical shaft) 84 is supported in the extension case 80 and gear case 82 to be freely rotated about the vertical axis. One end, i.e., the upper end of the drive shaft 84 is connected to the crankshaft (not shown) of the engine 28 and the other end, i.e., the lower end thereof is equipped with a pinion gear 86.

A propeller shaft 90 is supported in the gear case 82 to be freely rotated about the horizontal axis. One end of the propeller shaft 90 extends from the gear case 82 toward the rear of the outboard motor 10 and the propeller 32 is attached thereto, i.e., the one end of the propeller shaft 90, via a boss portion 92.

As indicated by the arrows in FIG. 3, the exhaust gas (combusted gas) emitted from the engine 28 is discharged from an exhaust pipe 94 into the extension case 80. The exhaust gas discharged into the extension case 80 further passes through the interior of the gear case 82 and the interior of the propeller boss portion 92 to be discharged into the water to the rear of the propeller 32.

The shift mechanism (now assigned with symbol 96) is also housed in the gear case 82. The shift mechanism 96 comprises a forward bevel gear 98, a reverse bevel gear 100, a clutch 102 disposed to be engageable with the gears 98 and 100, a shift slider 104 and a shift rod 106.

Figure 4:
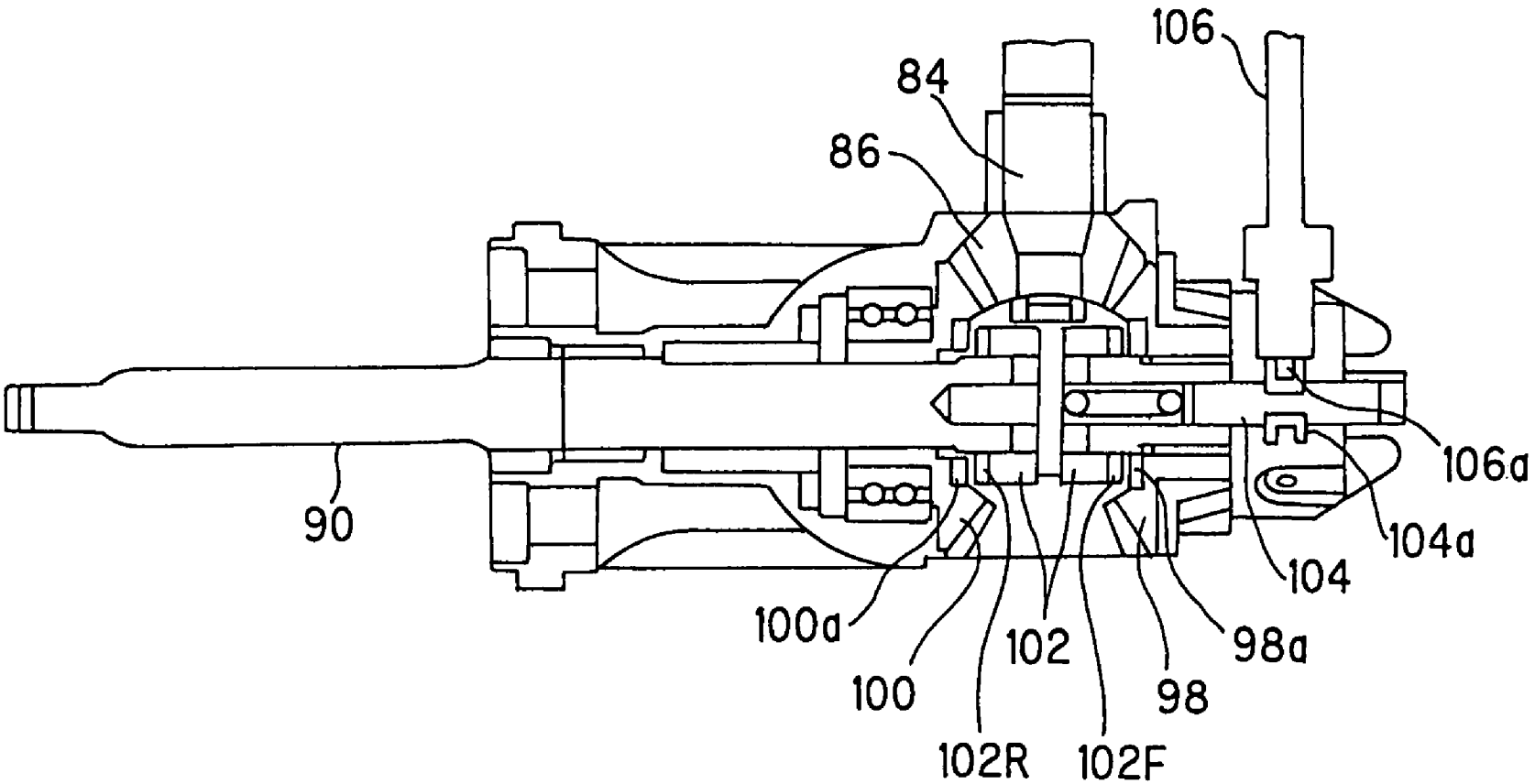
FIG. 4 is an enlarged explanatory view of a shift mechanism shown in FIG. 3.

FIG. 4 is an enlarged explanatory view of the shift mechanism 96 shown in FIG. 3.

As shown in FIG. 4, the forward bevel gear 98 and reverse bevel gear 100 are disposed onto the outer periphery of the propeller shaft 90 to be rotatable in opposite directions by engagement with the pinion gear 86. The forward bevel gear 98 and reverse bevel gear 100 are respectively formed with projections (teeth) 98*a* and projections (teeth) 100*a*.

Figure 5:
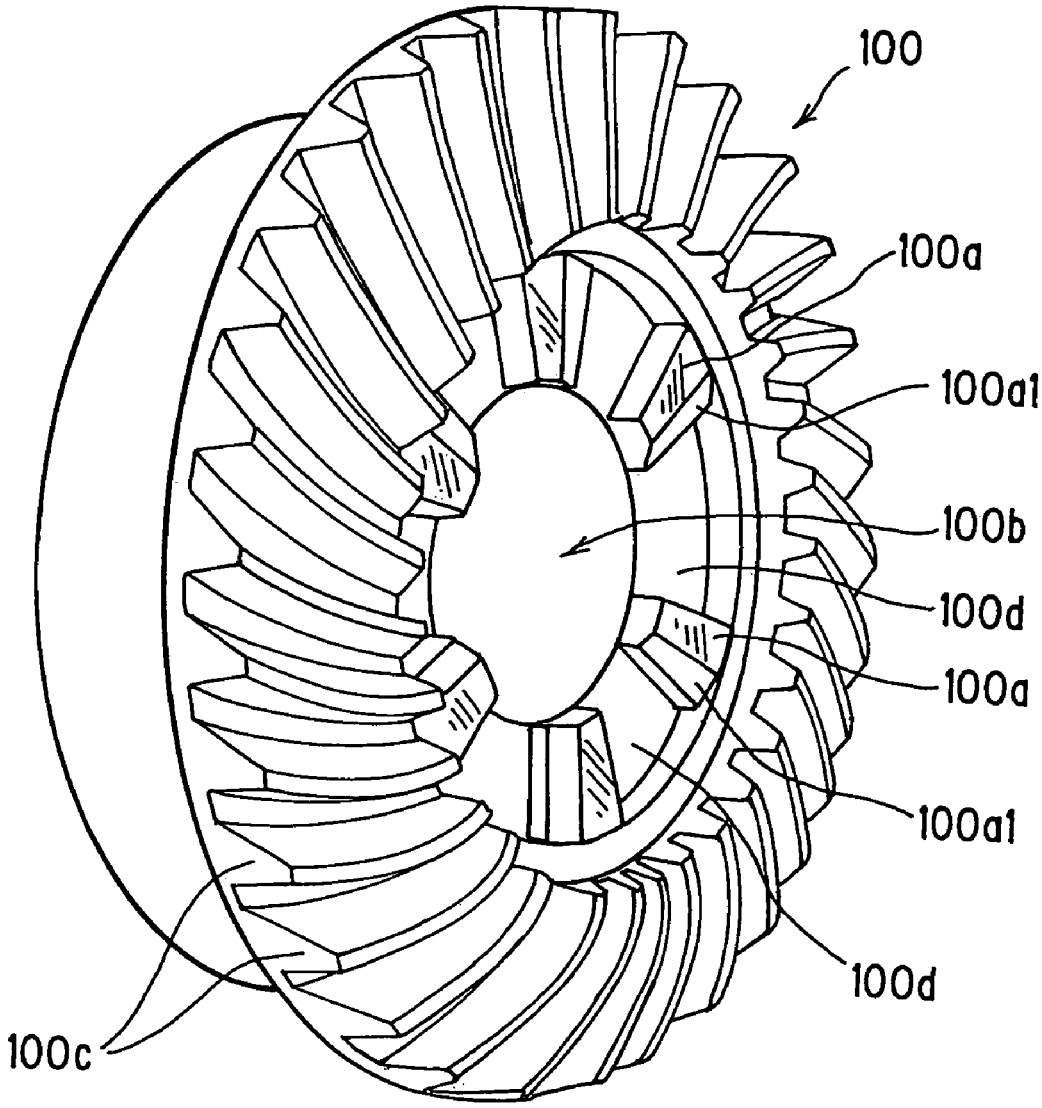
FIG. 5 is an enlarged perspective view of a reverse bevel gear shown in FIG. 4.

FIG. 5 is an enlarged perspective view of the reverse bevel gear 100.

The reverse bevel gear 100 has a central through-hole 100*b*. The propeller shaft 90 passes through the through-hole 100*b* to be rotatable with respect to the reverse bevel gear 100. The projections 100*a* (numbering six in this embodiment) are formed around the through-hole 100*b*. As illustrated, the opposite side surfaces of each projection 100*a* are formed with upwardly tapered faces 100*a*1 extending from the tip (top or distal end) to midway of the projection height so that the width of the projection 100*a* in the circumferential direction (circumferential direction of the reverse bevel gear 100) grows narrower with increasing proximity to the tip. Teeth 100*c* for engaging with the pinion gear 86 are formed outward of the projections 100*a*.

The foregoing description of the structure of the reverse bevel gear 100 also applies to the forward bevel gear 98. In other words, the forward bevel gear 98 has a central through-hole, the projections 98*a* (numbering six in this embodiment) formed around the through-hole and teeth formed around the projections 98*a*. In addition, the opposite side surfaces of each projection 98*a* are formed with upwardly tapered faces extending from the tip to midway of the projection height so that the width of the projection in the circumferential direction grows narrower with increasing proximity to the tip.

The explanation of FIG. 4 will be continued. The clutch 102 is located between the forward bevel gear 98 and reverse bevel gear 100. The clutch 102 rotates unitarily with the propeller shaft 90. As shown in the drawing, the clutch 102 has a cylindrical shape made coaxial with the propeller shaft 90 and its end face opposing the forward bevel gear 98 is formed with projections 102F for engagement with the projections 98*a*. The end face of the clutch 102 opposing the reverse bevel gear 100 is formed with projections 102R for engagement with the projections 100*a*.

Figure 6:
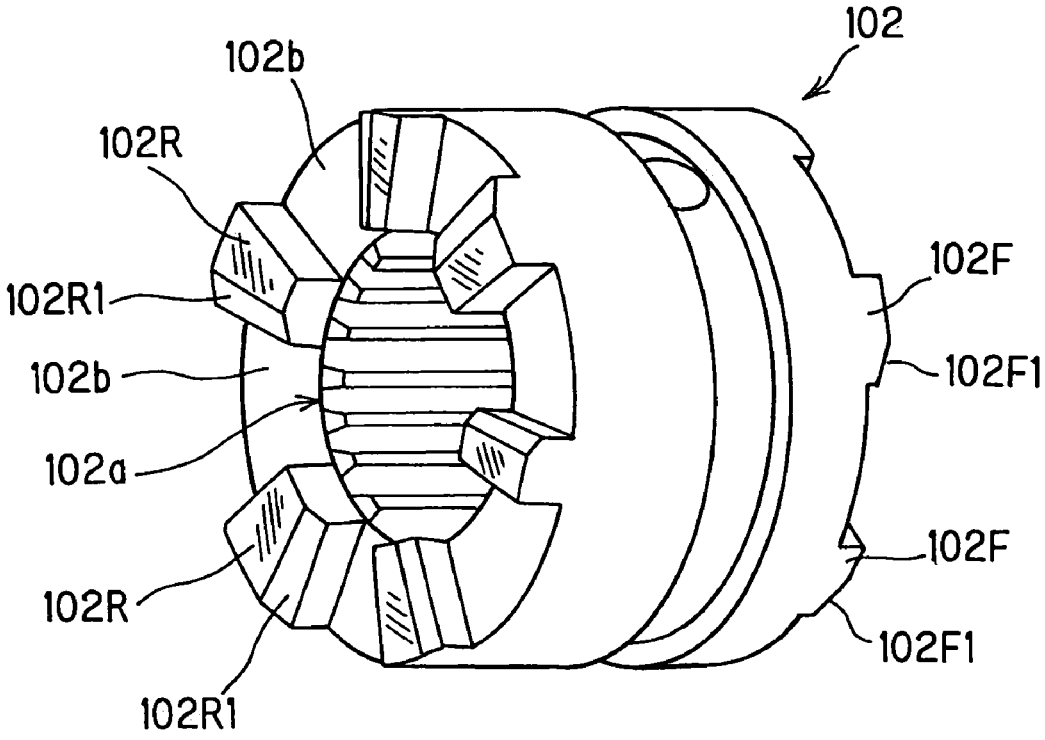
FIG. 6 is an enlarged perspective view of a clutch shown in FIG. 4.

FIG. 6 is an enlarged perspective view of the clutch 102.

The clutch 102 has a central through-hole 102*a*. The propeller shaft 90 passes through the through-hole 102*a*. The clutch 102 and propeller shaft 90 are engaged via splines so as to enable the clutch 102 to slide in the axial direction of the propeller shaft 90.

The projections 102F and projections 102R (numbering six each in this embodiment) are formed around the through-hole 102*a*. The opposite side surfaces of projection 102F, 102R are formed with upwardly tapered faces 102F1, 102R1 extending from the tip to midway of the projection height so that the width of the projection 102F, 102R in the circumferential direction (circumferential direction of the clutch 102) grows narrower with increasing proximity to the tip. The provision of the tapered faces enables smooth engagement of the projections. The shift mechanism 96 is thus equipped with a dog clutch comprising the projections 102F, 102R and the projections 98*a*, 100*a* of the respective gears.

The explanation of FIG. 4 will be resumed. The shift rod 106 is supported to be rotatable around a vertical axis and is provided with a rod pin 106*a* on the bottom. A shift slider 104 is provided beneath the shift rod 106. The shift slider 104 is connected at one end to the clutch 102 so as to slide and rotate unitarily with the clutch 102.

A groove 104*a* is formed around the shift slider 104. The rod pin 106*a* fits in the groove 104*a*. The rod pin 106*a* is formed at a location offset from the center of rotation of the shift rod 106 by a predetermined distance. As a result, rotation of the shift rod 106 causes the rod pin 106*a* to move while describing an arcuate locus whose radius is the predetermined distance (the offset from the center of rotation).

The movement of the rod pin 106*a* is transferred through the shift slider 104 to the clutch 102 as displacement parallel to the axial direction of the propeller shaft 90. As a result, the clutch 102 is slid to a position where it engages one or the other of the forward bevel gear 98 and reverse bevel gear 100 or to a position where it engages neither of them.

More specifically, when the clutch 102 is slid toward the forward bevel gear 98, the projections 102F of the clutch 102 engage the projections 98*a* of the forward bevel gear 98. Owing to the engagement of the projections 102F and projections 98*a*, the rotation of the drive shaft 84 is transmitted through the pinion gear 86, forward bevel gear 98 and clutch 102 to the propeller shaft 90, thereby rotating the propeller 32 to produce thrust in the direction of propelling the boat 12 forward. Thus the forward shift position is established.

When the clutch 102 is slid toward the reverse bevel gear 100, the projections 102R of the clutch 102 engage the projections 100*a* of the reverse bevel gear 100. Owing to the engagement of the projections 102R and projections 100*a*, the rotation of the drive shaft 84 is transmitted through the pinion gear 86, reverse bevel gear 100 and clutch 102 to the propeller shaft 90, thereby rotating the propeller 32 in the direction opposite from that during forward travel to produce thrust in the direction of propelling the boat 12 rearward. Thus the reverse shift position is established.

When the clutch 102 is stopped between the forward bevel gear 98 and reverse bevel gear 100 (i.e., when projections 102F, 102R of the clutch 102 are not engaged with either the projections 98*a* of the forward bevel gear 98 or the projections 100*a* of the reverse bevel gear 100), the drive shaft 84 and propeller shaft 90 are disconnected. Thus the neutral shift position is established.

The explanation of FIG. 3 will be resumed. The shift motor 38 is installed inside the engine cover 30 and its output shaft is connected to the upper end of the shift rod 106 through a reduction gear mechanism 110. Therefore, when the shift motor 38 is driven, its rotational output is transmitted to the shift rod 106 through the reduction gear mechanism 110, thereby rotating the shift rod 106. The rotation of the shift rod 106 slides the clutch 102 to select a shift position from among the foregoing forward, neutral and reverse positions. Thus the shift change is conducted by driving the shift motor 38 to operate the shift mechanism 96.

The completion of the shift change is discriminated or detected from the drive current supplied to the shift motor 38. The operation, i.e., the processing conducted for determining the completion of the shift change will now be explained.

Figure 7:
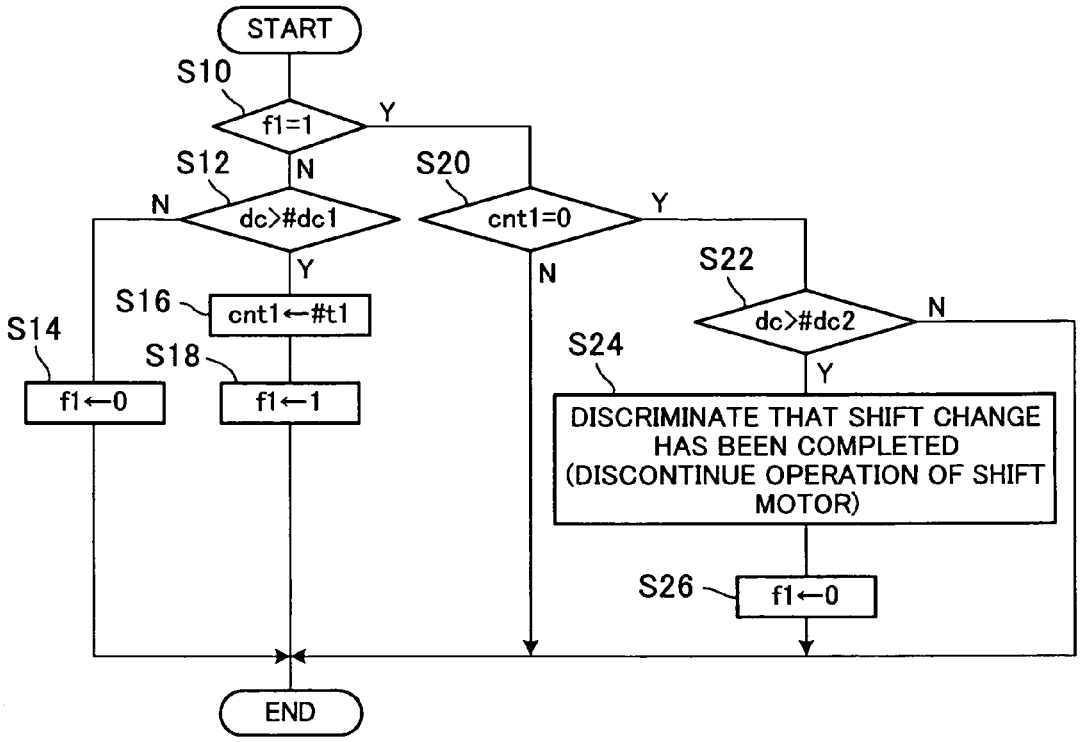
FIG. 7 is a flowchart showing the operation of the outboard motor shift control system according to the first embodiment.

FIG. 7 is a flowchart showing the operation of the outboard motor shift control system according to this embodiment. The illustrated program, whose specific purpose is to determine completion of the shift change to an in-gear position (forward position or reverse position), is periodically executed in the ECU 26 (once every 10 msec in this embodiment).

First, in S10, it is determined whether the bit of a first flag f1 is set to 1. The initial value of the bit of the first flag f1 is 0. Its value is set to 1 or reset to 0 in a later step explained below. When the result in S10 is NO, the program goes to S12, in which it is determined whether the drive current dc supplied to the shift motor 38 exceeds a first predetermined value #dc1.

The change in the drive current dc supplied to the shift motor 38 will be explained.

Figure 8:
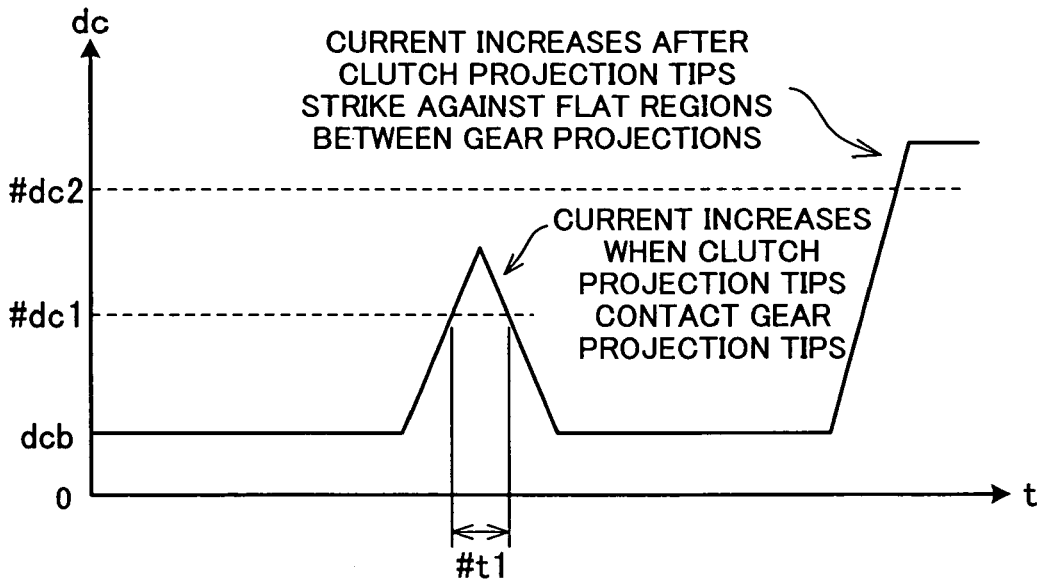
FIG. 8 is a time chart showing a first predetermined time period etc. referred to in the flowchart shown in FIG. 7.

FIG. 8 is a time chart showing the change of the drive current dc when the shift change to the in-gear position is implemented. Although the ensuing explanation with regard to FIG. 8 pertains to the shift change to the reverse position, the gist of the explanation also applies to the shift change to the forward position.

When the shift change to the reverse position is implemented, a certain constant drive current (hereinafter sometimes called the "basic drive current) dcb is supplied to the shift motor 38, as shown in FIG. 8, thereby sliding the clutch 102 toward the reverse bevel gear 100. When the clutch 102 slides toward the reverse bevel gear 100, the tips (tops or distal ends) of the projections 102R of the clutch 102 and the tips of the projections 100*a* of the reverse bevel gear 100 usually come into contact with each other, so that the sliding of the clutch 102 momentarily stops. Since the load of the shift motor 38 increases at this time, the drive current dc momentarily increases.

Then, owing to the rotation of the reverse bevel gear 100, a phase shift occurs between the projections 100*a* and projections 102R, so that sliding of the clutch 102 resumes to initiate meshing of the projections. Owing to the decrease in the load of the shift motor 38 at this time, the drive current dc again returns to the basic drive current dcb.

As shown in FIG. 8, the first predetermined value #dc1 is defined or determined to be greater than the basic drive current dcb. The determination in S12 of the flowchart of FIG. 7 as to whether the drive current dc has exceeded the first predetermined value #dc1 enables detection of the aforesaid momentary increase in the current, thereby enabling detection of the contacting of the tips of the projections 102R and projections 100*a* that occurs before the projections mesh.

With continuation of the sliding of the clutch 102, the tips of the projections 102R of the clutch 102 strike against the flat (non-projection) regions of the reverse bevel gear 100 (the lands between the projections, designated by the symbol 100*d* in FIG. 5) and the tips of the projections 100*a* of the reverse bevel gear 100 strike against the flat regions of the clutch 102 (the lands between the projections, designated by the symbol 102*b* in FIG. 6). As a result, the sliding of the clutch 102 stops and the shift change is completed. When the clutch 102 stops sliding, the load of the shift motor 38 increases, so that, as shown in FIG. 8, the drive current dc again rises.

Returning to the explanation of FIG. 7, when the result in S12 is NO, the program goes to S14, in which the bit of the first flag f1 is reset to 0. When the result in S12 is YES, the program goes to S16, in which a first counter (down counter) cnt1 is set to a first predetermined time period #t1, and to S18, in which the bit of the first flag f1 is set to 1.

The first predetermined time period #t1 will be explained. As shown in the time chart of FIG. 8, the first predetermined time period #t1 is set to the period of time that the drive current dc stays greater than the first predetermined value #dc1. The period that the drive current dc stays greater than the first predetermined value #dc1 varies depending on how long the tips of the projections 100*a* and 102R remain in contact. Specifically, the period that the drive current dc stays greater than the first predetermined value #dc1 increases with increasing period of contact between the tips of the projections. The first predetermined time period #t1 is predetermined or preset to the longest period that the drive current dc stays greater than the first predetermined value #dc1 as determined experimentally, for example. The contact period between the tips of the projections depends on the phase difference and rotational speed difference between the projections at the time their tips come into contact with each other.

The explanation of FIG. 7 will be resumed. When the bit of the first flag f1 is set to 1 in S18, the result in S10 in the next and later program cycles is YES and the program goes to S20. In S20, it is determined whether the value of the first counter cnt1 set to the first predetermined time period #t1 in S16 has reached 0, i.e., whether the first predetermined time period #t1 has elapsed since the drive current dc was found to have exceeded the first predetermined value #dc1. Simply stated, this amounts to determining whether the contact between the tips of the projections has ended and meshing begun.

When the result in S20 is NO, the remaining steps are skipped. When it is YES, the program goes to S22, in which it is determined whether the drive current dc exceeds a second predetermined value #dc2. As shown in FIG. 8, the second predetermined value #dc2 is set or determined to a larger value than the basic drive current dcb. As explained above, the sliding of the clutch 102 stops upon completion of the shift change, causing the drive current dc to increase. Therefore, in S22, whether or not the shift change has been completed is determined from whether or not the drive current dc has exceeded the second predetermined value #dc2.

When the result in S22 is NO (i.e., when sliding of the clutch 102 can be presumed to be in progress), the remaining steps are skipped. When it is YES, the program goes to S24, in which the shift change is discriminated or presumed to be completed and the operation of the shift motor 38 is discontinued, and to S26, in which the bit of the first flag f1 is reset to 0, whereafter the program is terminated.

As explained in the foregoing, in the outboard motor shift control system according to this embodiment, the current sensor 40 detects the drive current dc to be supplied to the shift motor 38 that operates the shift mechanism 96 and completion of the shift change is discriminated from the detected drive current dc. More specifically, changes in the load of the shift motor 38 that occur when the clutch 102 stops sliding are detected from changes in the drive current dc and completion of the shift change is discriminated based thereon. (To go into more detail, taking shifting to the reverse position as an example, the clutch 102 is slid until the tips of the projections 102R of the clutch 102 strike against the flat regions 100*d* of the reverse bevel gear 100 and the tips of the projections 100*a* of the reverse bevel gear 100 strike against the flat regions 102*b* of the clutch 102.) Owing to this configuration, completion of the shift change can be discriminated or detected accurately unaffected by aging and manufacturing inconsistencies of the shift mechanism 96.

Of particular note is that the shift change is discriminated or presumed to have been completed when the drive current dc is found to have exceeded the second predetermined value #dc2 after elapse of the first predetermined time period #t1 from the time it was found to have exceeded the first predetermined value #dc1. Owing this configuration, even if the drive current dc of the shift motor 38 should momentarily change before completion of the shift change (specifically, if the load of the shift motor 38 should momentarily change because the tips of projections of the clutch 102 and the projections of the gear 98 or 100 come into contact before the projections mesh), this can be prevented from being erroneously detected as completion of the shift change. Completion of the shift change can therefore be discriminated or detected with higher accuracy.

As shown in FIG. 8, the second predetermined value #dc2 is set to a larger value than the first predetermined value #dc1. As was pointed out above, the increase in load produced when the projection tips come in contact is momentary, so that the amount of increase in the drive current dc at this time is smaller than that at completion of the shift change. (At any rate, it does not exceed the amount of increase at completion of the shift change.) Therefore, by setting or determining the second predetermined value #dc2 to a larger value than the first predetermined value #dc1, contact between projection tips and completion of shifting can be more accurately discriminated. Nevertheless, it is possible to assign the first predetermined value #dc1 and second predetermined value #dc2 the same value. In fact, it is possible to detect or determine completion of the shift change even if the first predetermined value #dc1 is set larger than the second predetermined value #dc2.

In the foregoing, although the first predetermined time period #t1 is said to be set to the longest period that the drive current dc stays greater than the first predetermined value #dc1, it may instead be set to a value that is longer than this value. However, in the case where the longest period that the drive current dc can continuously exceed the first predetermined value #dc1 is shorter than the drive current dc sampling interval (the execution cycle of the flowchart of FIG. 7), the first predetermined time period #t1 need not be measured. In this case, when the drive current dc is found to have exceeded the first predetermined value #dc1 in any given program cycle, it can be presumed that the shift change has been completed if the drive current dc exceeds the second predetermined value #dc2 in the next program cycle.

An outboard motor shift control system according to a second embodiment of the invention will now be explained.

Figure 9:
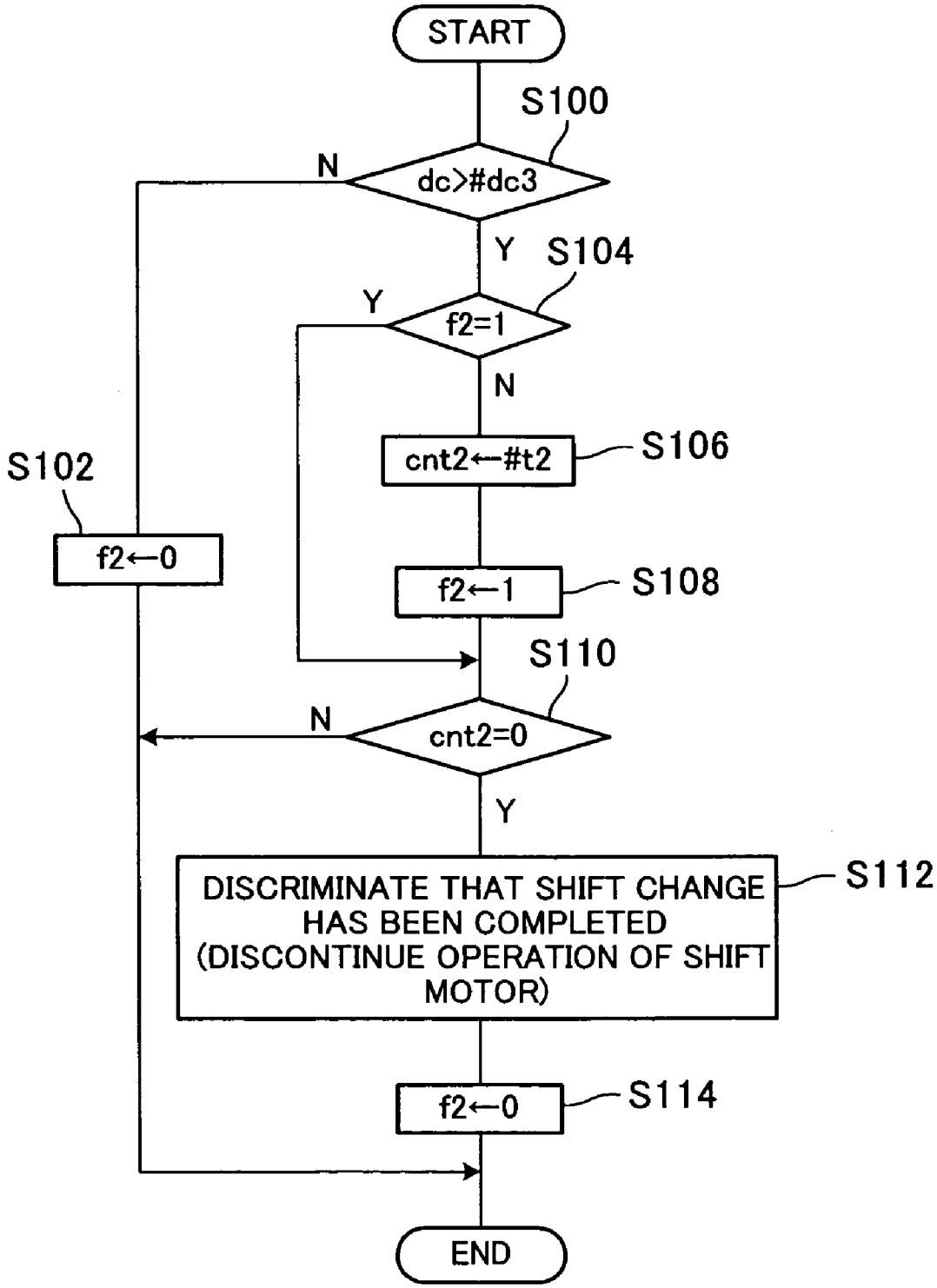
FIG. 9 is a flowchart, similar to FIG. 7, but showing the operation of an outboard motor shift control system according to a second embodiment.

FIG. 9 is a flowchart showing the operation, i.e., the sequence of the processing steps for determining completion of the shift change executed in the outboard motor shift control system according to the second embodiment. The program shown in FIG. 9 is periodically executed in the ECU 26 (once every 10 msec in this embodiment).

First, in S100, it is determined whether the drive current dc supplied to the shift motor 38 has exceeded a third predetermined value (current value) #dc3. Like the first predetermined value #dc1 and second predetermined value #dc2 in the first embodiment, the third predetermined value #dc3 is also made greater than the basic drive current dcb.

When the result in S100 is NO, the program goes to S102, in which the bit (initially 0) of a second flag f2 is reset to 0. When the result in S100 is YES, the program goes to S104, in which it is determined whether the bit of the second flag f2 is set to 1. When the result in S104 is NO, the program goes to S106, in which a second counter (down counter) cnt2 is set to a second predetermined time period #t2, and to S108, in which the bit of the second flag f2 is set to 1. Next, in S110, it is determined whether the value of the second counter cnt2 set to the second predetermined time period #t2 in S106 has reached 0. On the other hand, when the result in S104 is YES, S110 is executed immediately without executing S106 and S108. The check made in S110 is for determining whether the drive current dc has exceeded the third predetermined value #dc3 after elapse of the second predetermined time period #t2.

Figure 10:
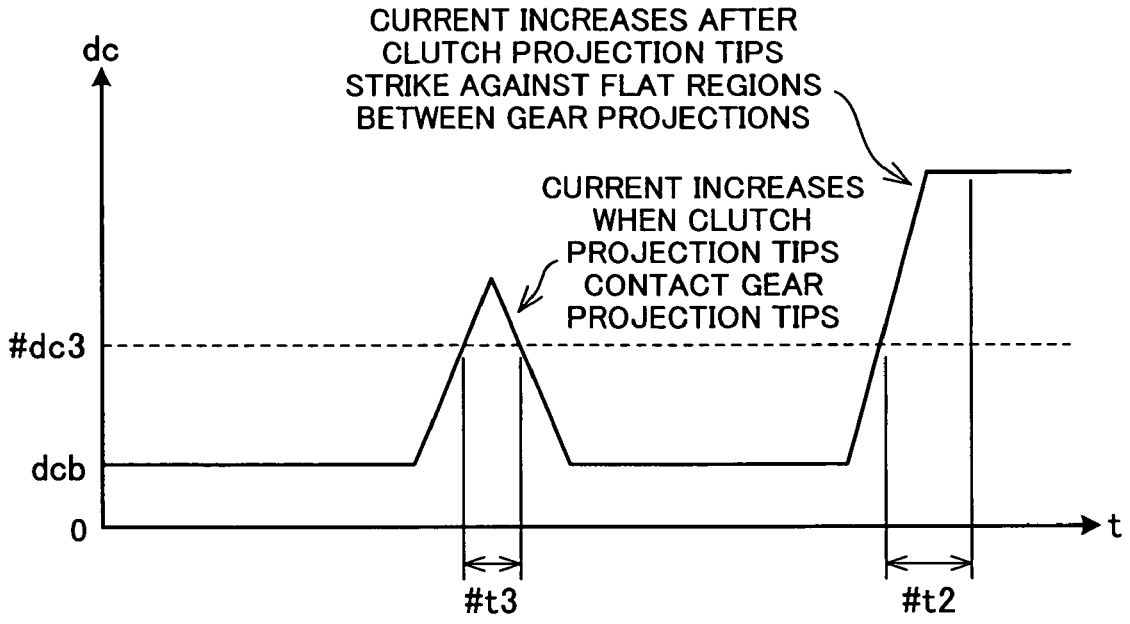
FIG. 10 is a time chart similar to FIG. 8 but showing a second predetermined time period etc. referred to in the flowchart shown in FIG. 9.

The second predetermined time period #t2 will be explained with reference to FIG. 10. As shown in FIG. 10, the second predetermined time period #t2 is set longer than the third predetermined time period #t3 analogous to the first predetermined time period #t1 in the first embodiment (i.e., the longest period that the drive current dc can stay greater than the third predetermined value #dc3). Therefore, the fact that the drive current cit continuously exceeds the third predetermined value #dc3 during the second predetermined time period #2 can be taken to mean that the increase in the drive current dc has not been caused by the tips of the projections coming into contact but is attributable to completion of shifting.

The explanation of the flowchart of FIG. 9 will be continued. When the result in S110 is NO, the remaining steps are skipped. When it is YES, the program goes to S112, in which the shift change is discriminated or presumed to be completed and the operation of the shift motor 38 is discontinued, and to S114, in which the bit of the second flag f2 is reset to 0, whereafter the program is terminated.

Other aspects of the structure of the outboard motor shift control system according to the second embodiment are similar to those of the first embodiment and will not be described again.

As explained in the foregoing, the outboard motor shift control system according to the second embodiment is configured to determine that shift change has been completed when the drive current dc is found to have continuously exceeded the third predetermined value #dc3 during the second predetermined time period #t2. Therefore, as in the first embodiment, even if the drive current dc of the shift motor 38 should momentarily change before completion of the shift change (specifically, if the load of the shift motor 38 should momentarily change because the tips of projections of the clutch 102 and the projections of the gear 98 or 100 come into contact before the projections mesh), this can be prevented from being erroneously detected as completion of the shift change. Completion of the shift change can therefore be detected with higher accuracy.

In the case where the longest period that the drive current dc can continuously exceed the third predetermined value #dc3 is shorter than the drive current dc sampling interval (the execution cycle of the flowchart of FIG. 9), the second predetermined time period #t2 need not be measured. In this case, it can be presumed that shifting has been completed if the drive current dc exceeds the third predetermined value #dc3 in two consecutive program cycles.

Figure 11:
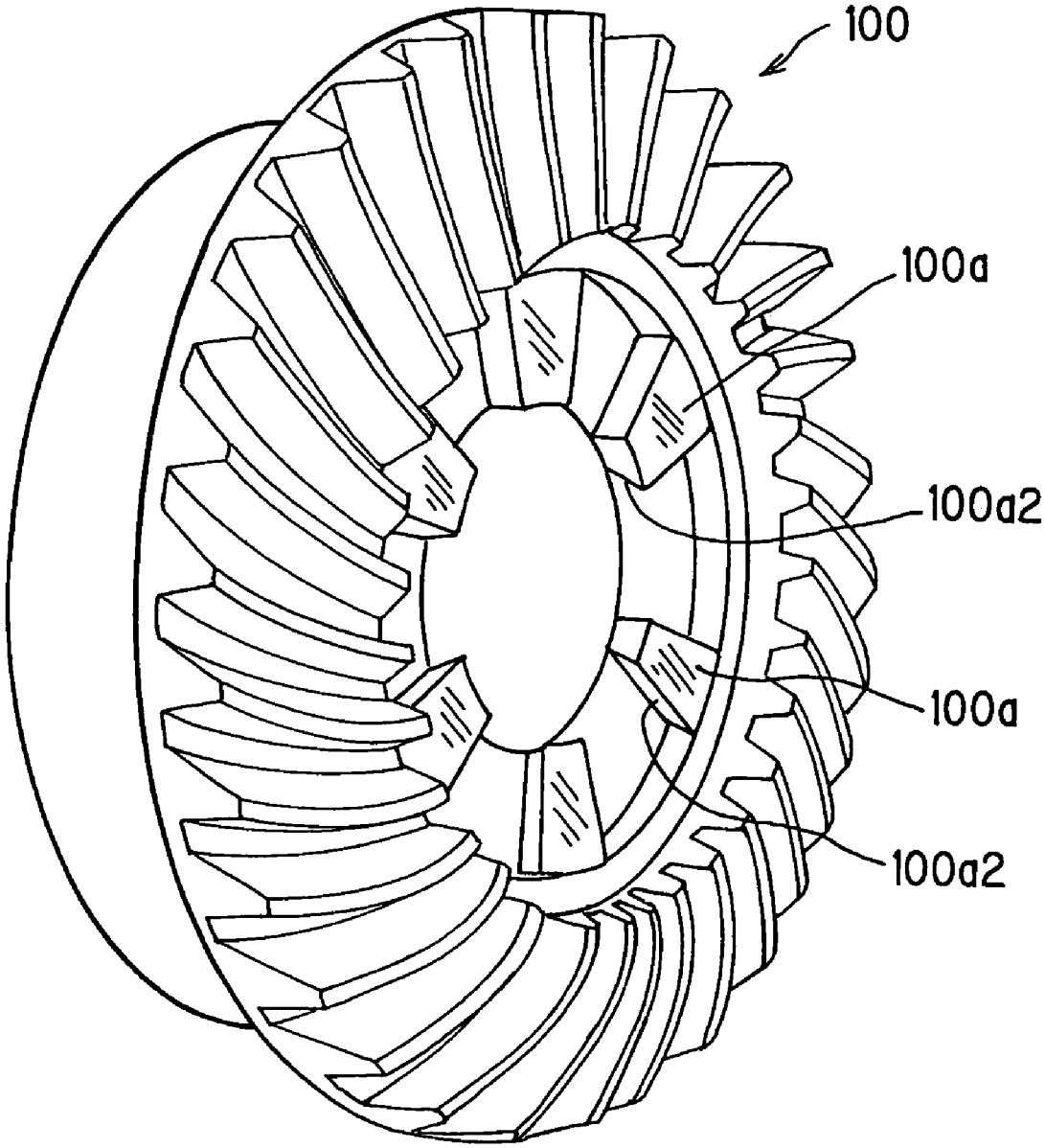
FIG. 11 is an enlarged perspective view similar to FIG. 5, but showing an alternative example of tapered faces formed on projections of the reverse bevel gear shown in FIG. 4.

In the first and second embodiments, the projections 98*a*, 100*a* of the forward bevel gear 98 and reverse bevel gear 100 can instead be formed with downwardly tapered faces. As shown in FIG. 11 by way of example for the reverse bevel gear 100, the downwardly tapered faces impart the side faces of the projections 100*a* with a slope in the opposite direction from that imparted by the upwardly tapered faces 100*a*1 explained with reference to the first embodiment, so that the width of the projections 100*a* (width in the circumferential direction of the reverse bevel gear 100) grows wider with increasing proximity to the tips.

Figure 12:
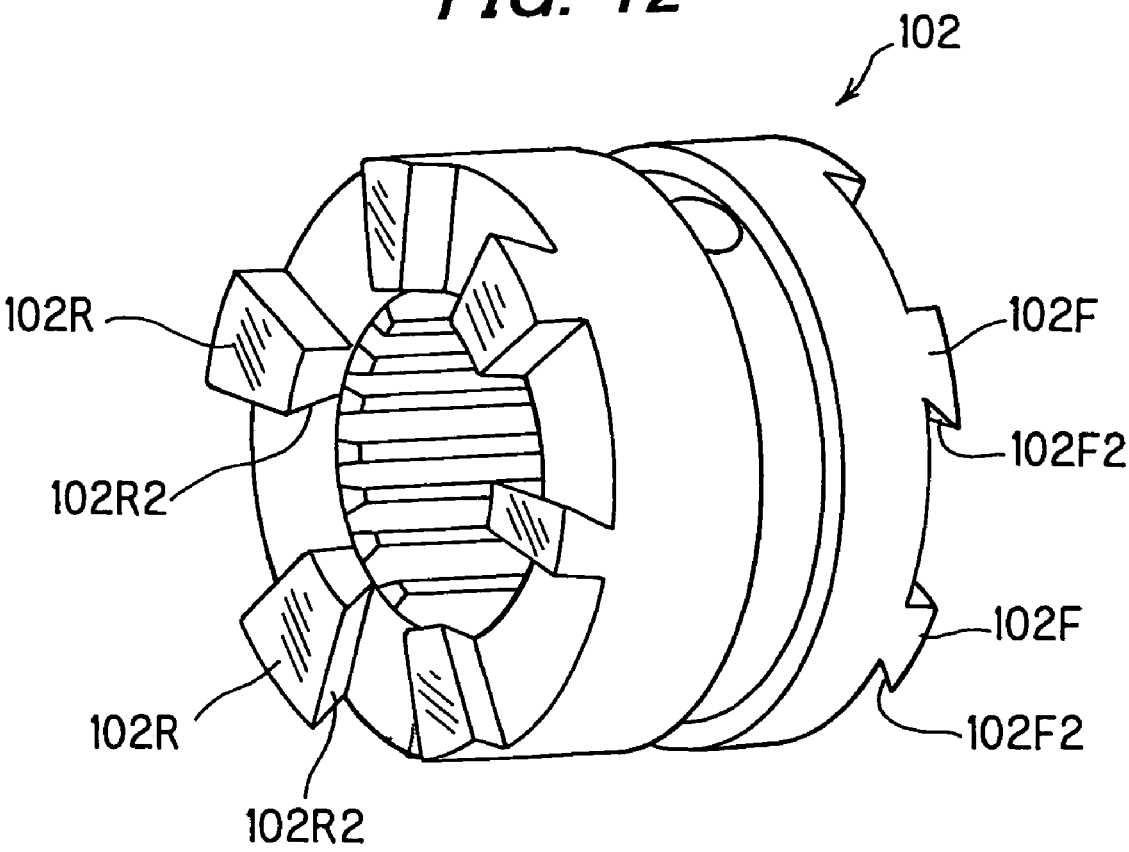
FIG. 12 is an enlarged perspective view similar to FIG. 6, but showing an alternative example of tapered faces formed on projections of the clutch shown in FIG. 4.

When the projections 98*a*, 100*a* of the forward bevel gear 98 and reverse bevel gear 100 are formed with downwardly tapered faces, complementary downwardly tapered faces are also formed on the projections 102F, 102R of the clutch 102. In FIG. 12, the downwardly tapered faces formed on the projections 102F, 102R are designated by symbols 102F2, 102R2. The provision of downwardly tapered faces in this manner helps to heighten the engaging force of the projections.

Figure 13:
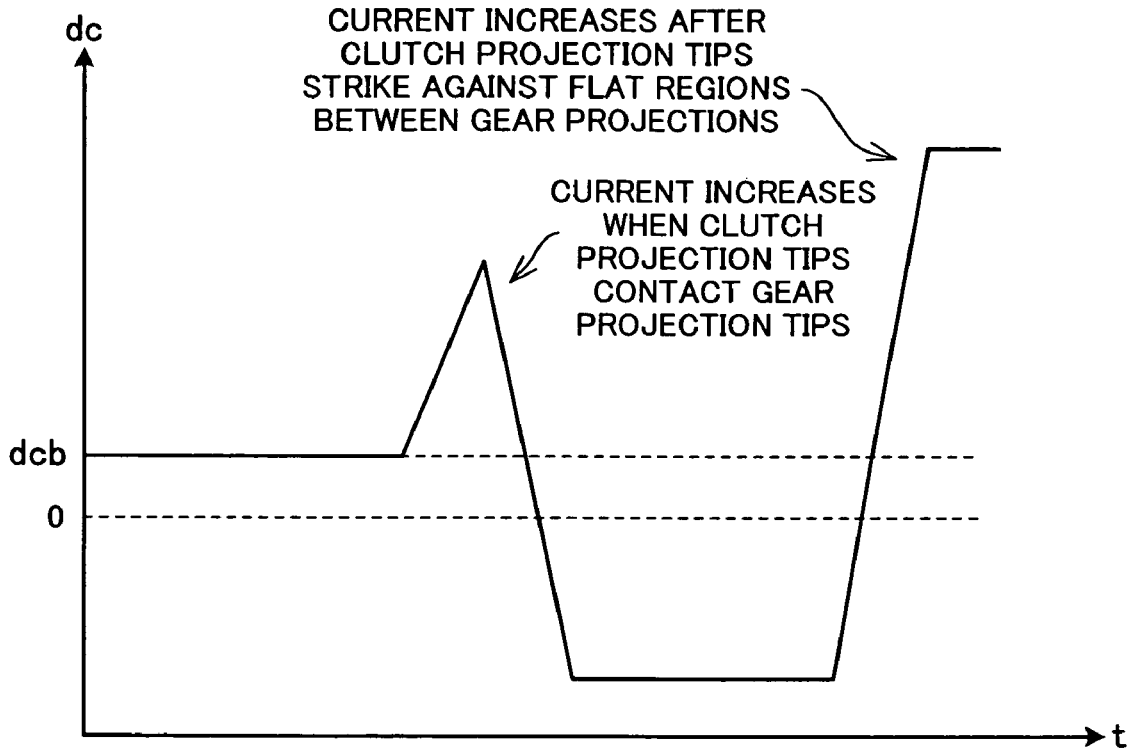
FIG. 13 is a time chart similar to FIG. 8 but showing the change in drive current when the shift change is performed using the reverse bevel gear shown in FIG. 11 and the clutch shown in FIG. 12.

FIG. 13 is a time chart showing the change of the drive current dc when a shifting operation is performed in an outboard motor shift control system whose projections are formed with downwardly tapered faces.

When the projections are formed with the aforesaid downwardly tapered faces, the engagement between the downwardly tapered faces promotes meshing between the projections. As a result, the load of the shift motor 38 decreases between the start of projection meshing and the completion of shifting, so that, as shown in FIG. 13, the drive current dc falls below the basic drive current dcb. Even when the drive current dc changes in this manner, however, completion of shifting can still be determined or detected by carrying out the processing operations of the first embodiment explained with reference to the flowchart of FIG. 7 or the processing operations of the second embodiment explained with reference to the flowchart of FIG. 9.

The first and second embodiments are thus configured to have a system for controlling shift of an outboard motor (10) mounted on a stem of a boat (12) and having a powered propeller (32) that propels the boat in a forward or reverse direction in response to a shift position selected one from among a forward position, a reverse position and a neutral position, comprising: a shift mechanism (96) including at least a forward gear (98), a reverse gear (100) and a clutch (102) disposed to be engageable with the forward gear and the reverse gear; an electric actuator (shift motor 38) moving the clutch to engage with the forward gear to change shift to the forward position, or to engage with the reverse gear to change shift to the reverse position, or to disengage the clutch from the forward gear or the reverse gear to change shift to the neutral position; a current sensor (40) detecting current (dc) supplied to the actuator; a discriminator (ECU 26, S10 to S26; S100 to S112) discriminating whether the shift change is completed based on the detected current.

In the system, the discriminator includes: a first determiner (ECU 26, S12) determining whether the detected current (dc) exceeds a first predetermined value (#dc1); and a second determiner (ECU 26, S22) determining whether the detected current (dc) exceeds a second predetermined value (#dc2); and discriminates that the shift change is completed when the detected current is determined to exceed the second predetermined value after a first predetermined time period (#t1) has elapsed since the detected current was determined to have exceeded the first predetermined value (S24).

In the system, the first predetermined time period (#t1) is determined to a time period during which tips of projections (98*a*, 100*a*, 102F, 102R) of the gear and the clutch remain in contact with each other.

In the system, the discriminator includes: a third determiner (ECU 26, S100) determining whether the detected current (dc) exceeds a third predetermined value (#dc3); and discriminates that the shift change is completed when the detected current is determined to continuously exceed the third predetermined value during a second predetermined time period (#t2) (S12).

In the system, the second predetermined time period (#t2) is determined to a time period that is longer than a time period during which tips of projections (98*a*, 100*a*, 102F, 102R) of the gear and the clutch remain in contact with each other.

In the embodiments set out in the foregoing, the actuator used to operate the shift mechanism 96 is an electric motor (shift motor 38). However, the invention can also be implemented using any of various other types of electrically powered actuators. When a hydraulic actuator is utilized, for example, completion of shifting can be determined from the detected value of the drive current of the electric motor that drives the hydraulic pump.

Japanese Patent Application No. 2004-309809 filed on Oct. 25, 2004, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling shift of an outboard motor mounted on a stern of a boat and having a powered propeller that propels the boat in a forward or reverse direction in response to a shift position selected one from among a forward position, a reverse position and a neutral position, comprising:

a shift mechanism including at least a forward gear, a reverse gear and a clutch disposed to be engageable with the forward gear and the reverse gear;

an electric actuator moving the clutch to engage with the forward gear to change shift to the forward position, or to engage with the reverse gear to change shift to the reverse position, or to disengage the clutch from the forward gear or the reverse gear to change shift to the neutral position;

a current sensor detecting current supplied to the actuator; and a discriminator discriminating whether the shift change is completed based on the detected current.

2. The system according to claim 1, wherein the discriminator includes:

a first determiner determining whether the detected current exceeds a first predetermined value; and a second determiner determining whether the detected current exceeds a second predetermined value;

and discriminates that the shift change is completed when the detected current is determined to exceed the second predetermined value after a first predetermined time period has elapsed since the detected current was determined to have exceeded the first predetermined value.

3. The system according to claim 2, wherein the first predetermined time period is a time period during which tips of projections of a gear and the clutch remain in contact with each other.

4. The system according to claim 1, wherein the discriminator includes:

a determiner determining whether the detected current exceeds a predetermined value;

and discriminates that the shift change is completed when the detected current is determined to continuously exceed the predetermined value during a predetermined time period.

5. The system according to claim 4, wherein the second predetermined time period is determined to a time period that is longer than a time period during which tips of projections of the gear and the clutch remain in contact with each other.

6. A method of controlling shift of an outboard motor mounted on a stem of a boat and having a powered propeller that propels the boat in a forward or reverse direction in response to a shift position selected one from among a forward position, a reverse position and a neutral position, a shift mechanism including at least a forward gear, a reverse gear and a clutch disposed to be engageable with the forward gear and the reverse gear and an electric actuator moving the clutch to engage with the forward gear to change shift to the forward position, or to engage with the reverse gear to change shift to tie reverse position, or to disengage the clutch from the forward gear or the reverse gear to change shift to the neutral position, comprising the steps of:

detecting current supplied to the actuator; and discriminating whether the shift change is completed based on the detected current.

7. The method according to claim 6, wherein the step of discriminating involves:

determining whether the detected current exceeds a first predetermined value; and determining whether the detected current exceeds a second predetermined value;

and discriminating that the shift change is completed when the detected current is determined to exceed the second predetermined value after a first predetermined time period has elapsed since the detected current was determined to have exceeded the first predetermined value.

8. The method according to claim 7, wherein the first predetermined time period is a time period during which tips of projections of a gear and the clutch remain in contact with each other.

9. The method according to claim 6, wherein the step of discriminating involves:

determining whether the detected current exceeds a predetermined value;

and discriminating that the shift change is completed when the detected current is determined to continuously exceed the predetermined value during a predetermined time period.

10. The method according to claim 9, wherein the predetermined time period is a time period that is longer than a time period during which tips of projections of a gear and the clutch remain in contact with each other.

* * * * *

UNITED STATES PATENT AND TRADEMARK OFFICE

CERTIFICATE OF CORRECTION

PATENT NO. : 7,153,175 B2
APPLICATION NO. : 11/256335
DATED : December 26, 2006
INVENTOR(S) : Takada et al.

It is certified that error appears in the above-identified patent and that said Letters Patent is hereby corrected as shown below:

Column 12, line 44(Claim 6 line2)
Change "stem" to -- stern --

Column 12, line 53(Claim 6 line 11)
Change "tie" to --the--

Signed and Sealed this

Twentieth Day of March, 2007

JON W. DUDAS
*Director of the United States Patent and Trademark Office*